United States Patent [19]

Mitri

[11] Patent Number: 4,726,487

[45] Date of Patent: Feb. 23, 1988

[54] DISPOSABLE BEVERAGE CONTAINER

[76] Inventor: George Mitri, 17508 Lauralbrook, Cerritos, Calif. 90701

[21] Appl. No.: 920,683

[22] Filed: Oct. 17, 1986

[51] Int. Cl.[4] ..... B65D 25/00

[52] U.S. Cl. ..... 220/90.2; 220/90.6; 220/85 K

[58] Field of Search ..... 220/90.2, 90.4, 90.6, 220/85 K; 229/1.5 B

[56] References Cited

U.S. PATENT DOCUMENTS

| | | | |
|---|---|---|---|
| 2,116,418 | 5/1938 | Smithson | 220/90.6 |
| 2,203,476 | 6/1940 | Trabold | 220/90.6 |
| 2,725,732 | 12/1955 | Somoza | 220/90.6 |
| 2,729,956 | 1/1956 | Gilbert | 220/90.2 X |
| 2,782,614 | 2/1957 | Currie | 220/90.6 |
| 3,103,297 | 9/1963 | Taft | 220/90.2 |
| 3,185,341 | 5/1965 | Barbour | 220/90.2 X |
| 3,341,062 | 9/1967 | Phillips | 220/90.4 |

*Primary Examiner*—Steven M. Pollard
*Attorney, Agent, or Firm*—Charles H. Thomas

[57] ABSTRACT

A frusto-conical beverage container, equipped with a lid, is provided with an annular shield or guard that surrounds the mouth of the cup and the lid positioned thereon. When a plurality of such containers are carried in a sack or tray, the guard prevents dislodgment of the lids and leakage of the contents of the cups which typically results from such dislodgment. The upper edge of the guard coaxially surrounds the cup mouth and the lid in spaced separation therefrom, while the lower edge of the guard resides in contact with the wall of the cup. The guard may be formed as a unitary structure with the cup or as a separate sleeve removable therefrom. The guard may be formed with a breakaway section to allow the consumer's lips access to the rim of the mouth of the cup.

9 Claims, 7 Drawing Figures

FIG.4
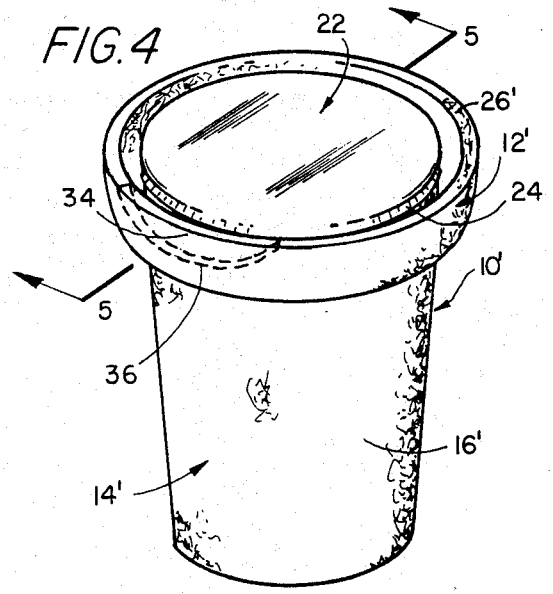
FIG.5
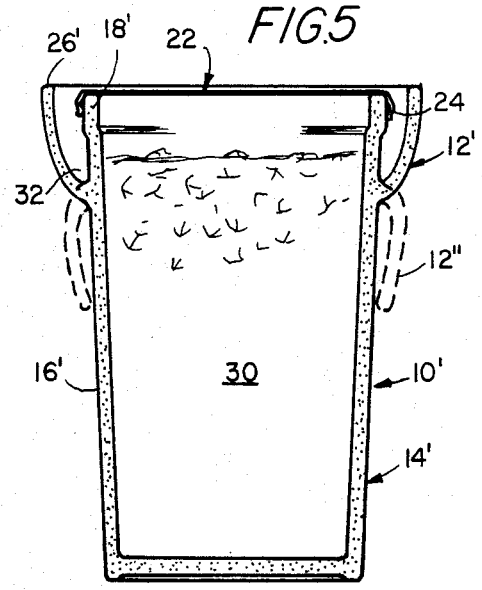
FIG.6
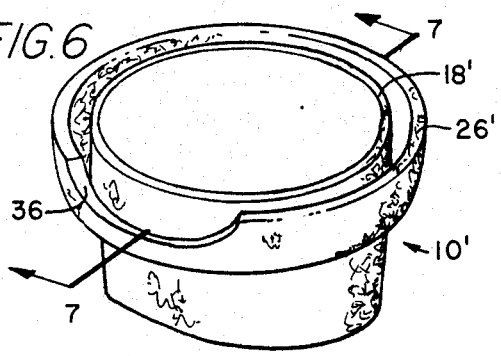
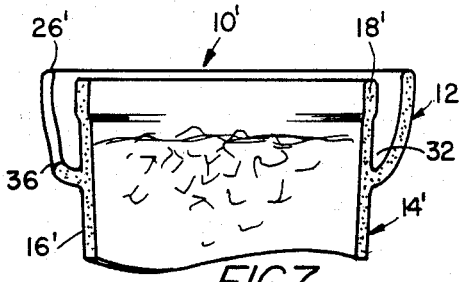
FIG.7
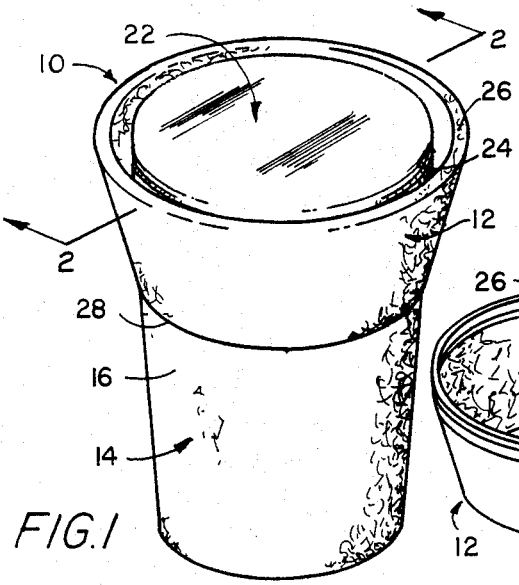
FIG.1
FIG.3
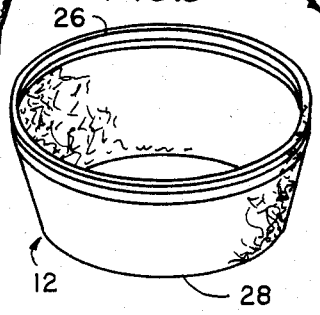
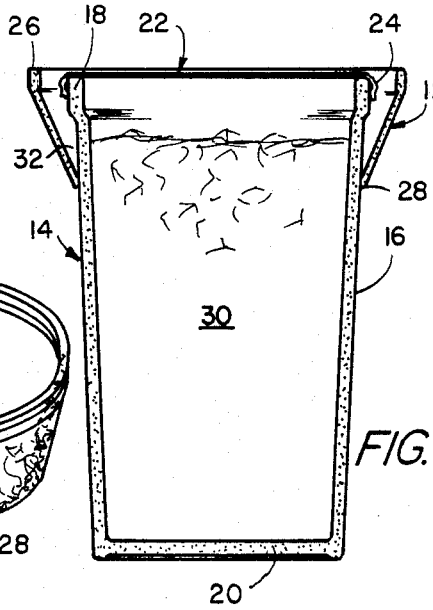
FIG. 2

DISPOSABLE BEVERAGE CONTAINER

BACKGROUND OF THE INVENTION

1. Field of the Invention

The present invention relates to disposable beverage containers.

2. Description of the Prior Art

Disposable beverage containers formed of styrofoam, waxed paper, waxed cardboard, or some other economical material are widely used in commercial food preparation establishments known as "fast-food" outlets. In such food preparation establishments meals and beverages are prepared and packaged in low cost, disposable containers primarily for consumption off the premises. Since the beverage containers utilized are not designed for reuse and are discarded promptly following consumption of the beverage packaged therein, economy in packaging is extremely important. However, in efforts to produce disposable beverage containers at as low a cost as possible, the manufacturers of conventional, disposable beverage drinking containers have produced products which exhibit several significant defects.

Beverages prepared for consumption off premises are typically packaged in frusto-conical styrofoam or waxed paper cups with thin plastic lids disposed across the open mouths of the cups. Conventional plastic lids of this type are of a circular configuration with narrow, downturned lips at their outer circumferences. The lids span the open mouths of the beverage drinking containers, and the downwardly depending lips encircle and grip the upper edges of the walls defining the beverage container mouths.

Consumers frequently carry lidded beverage containers of the type described together in close proximity to each other in trays, cardboard boxes or cartons and in paper sacks. The mouths of conventional beverage containers are typically larger in diameter than the bases thereof, so that the peripheral edges of the lids of beverage container drinking cups which are carried together are frequently jostled against each other. Very frequently the lids of such containers are jostled loose, from the mouths of the cups to which they are secured with the result that liquid is likely to leak from the mouths of the cups.

In many instances disposable beverage containers are carried in the same box, tray or sack as food items, and are transported significant distances in automotive vehicles prior to consumption. Due to jerking and vibration resulting from operation of the vehicle, beverages leaking from the containers very frequently spill into food packaged with the beverages, or onto the vehicle upholstery, much to the dissatisfaction of consumers. Nevertheless, while this problem has persisted for many years, no adequate solution has heretofore been found. Fluid tight lids can, of course, be constructed, but the inordinately large expense of such devices, has been an insurmountable obstacle to their use in disposable food packaging.

SUMMARY OF THE INVENTION

A principal object of the present invention is to provide an improved beverage container which can be carried and transported away from the premises of a commercial "fast-food" establishment at which the beverage is packaged without spilling liquid contained therein.

A further object of the invention is to allow disposable beverage containers of conventional frusto-conical design and having conventional disposable lids, to be carried in conventional boxes, trays and sacks in such a manner that dislodgment of the lids caused by jostling of the containers against each other is unlikely to occur. As a consequence, there is a very significantly reduced incidence of liquid soaked food and soiling of upholstery when transporting beverages in containers constructed in accordance with the invention.

A further object of the invention is to provide a disposable beverage container with a guard or shield disposed concentrically about the mouth of the container in spaced separation therefrom, so that forces resulting from jostling and contact of the containers with each other do not act against the lids of the containers.

A further object of the invention is to define a guard or shield in a disposable beverage container which not only protects the lid of the container cup from dislodgment, but which also confines any spillage that occurs despite such protection to a gutter defined between the shield and the cup. Any liquid which does accidentally spill or leak will thereby not escape from the container to soak other food items packaged therewith or to soil the upholstery of a vehicle in which the food is transported.

In one broad aspect the present invention may be considered to be an improved, disposable beverage container comprising a concave cup having an annular wall that forms a mouth at its upper edge. The container of the invention includes a lid which extends transversely across the mouth. The container also includes an annular concentric guard extending upwardly and outwardly from the wall of the cup to coaxially surround the mouth in transversely spaced separation therefrom.

In another broad aspect the invention may be considered to be an improvement in a disposable beverage container formed as a cup having an annular rim and a lid releasably secured to the annular rim. The improvement of the invention is an annular collar secured to the cup to surround the annular rim in spaced separation therefrom to thereby serve as a protective shield about the rim.

The protective shield, sleeve or collar of the invention may be formed as a unitary structure with the cup. In such an embodiment the collar preferably includes a breakaway or lip access section delineated by boundary formed as a weakened demarcation or line in the structure of the collar. The breakaway section may thereby be separated from the remainder of the collar along the boundary when force is applied thereto. The breakaway lip access panel is removed by holding the cup in one hand and gripping the access panel between the thumb and forefinger of the other hand. The access panel is then forced downwardly and outwardly away from the mouth of the cup until it breaks free from the remaining structure of the collar along the weakened boundary. The boundary may be formed as a thin web in the structure of the collar, by a linear pattern of perforations through the collar, by scoring of the collar or by some other means conventionally used to provide a demarcation or delineation of a breakaway section.

The guard of the beverage container of the invention may also be formed as a structure separate and distinct from the cup. In such an embodiment the guard typically is in the form of a frusto-conical, annular structure having an angle of draft or taper significantly larger than the draft or taper of the frusto-conical beverage cup upon which it is removably placed. The guard of such an embodiment has an upper, circular edge of diameter greater than the diameter of the lid and the mouth of the cup. The lower edge of the guard has a diameter larger than the base of the cup, but smaller than the mouth of the cup. The guard is inserted coaxially over the bottom of the cup and is moved upwardly relative thereto until the upper edge of the sleeve reaches or extends above the mouth of the cup and the lower edge of the sleeve is frictionally lodged against the wall of the cup.

When beverages are packaged in improved, disposable beverage containers according to the invention, the annular guards are positioned to surround the mouths of the beverage containers in spaced separation therefrom when the goods are presented to consumers. The improved beverage containers may thereby be packaged together in conventional trays, boxes or sacks. Jostling of the containers together while transporting them from one location to another does not result in spillage, since the lids of the beverage container cups remain securely in position over the mouths of the cups. Jostling of the cups together merely results in contact between the guards of adjacent containers. The guards serve to fend off forces received from adjacent containers. The guards or shields of adjacent containers can be repeatedly jostled together without any spillage whatsoever from the cups with which they are utilized.

Once the beverages have been transported to the locations at which they are to be imbibed, at least a portion of the guard must be removed. Where the guards are formed as annular, removable sleeves, the sleeves are pressed downwardly relative to the frusto-conical cups upon which they are removably mounted. The mouths of the cups are then readily accessible to the lips of consumers for imbibation of beverages contained within the cups. Likewise, where the guards of the containers of the invention are of a unitary construction with the cups, a breakaway section of the guard is removed so that the lips of the consumer can reach the mouth of the cup. In all events, the guards or shields are discarded, along with the cups, following imbibation of the beverages packaged therein.

The beverage container guard of the invention may be formed of the same economical materials as the container cups. Typically the guards and cups are both formed of styrofoam, waxed paper or waxed cardboard.

The invention may be described with greater clarity and particularity by reference to the accompanying drawings.

DESCRIPTION OF THE DRAWINGS

FIG. 1 is a perspective view of one preferred embodiment of an improved disposable beverage container according to the invention.

FIG. 2 is a sectional elevational view of the embodiment of FIG. 1 taken along the lines 2—2 thereof.

FIG. 3 is an isolated perspective view of the cup guard of FIGS. 1 and 2.

FIG. 4 is a perspective view of another preferred embodiment of the invention.

FIG. 5 is a sectional elevational view taken along the lines 5—5 of FIG. 4.

FIG. 6 is a perspective view of the upper portion of the embodiment of FIG. 5 with the cup lid and the breakaway, lip access section thereof removed.

FIG. 7 is a sectional elevational view taken along the lines 7—7 of FIG. 6.

DESCRIPTION OF THE EMBODIMENT

FIG. 1 illustrates a beverage container 10 constructed according to the invention and employing a rim guard 12. The beverage container 10 is comprised of a concave cup 14 having a frusto-conical wall 16, tapered with a slight draft and narrowing from top to bottom as best illustrated in FIG. 2. The cup 14 has an annular rim 18 which forms an open mouth and which is defined at the upper extremity of the wall 16 and a circular base 20, of a diameter smaller than the rim 18, at the lower extremity of the wall 16. The beverage container 10 includes a transverse, circular lid 22 having an annular, downturned lip 24 at its periphery. The lid 22 is releasably securable to the rim 18 across the mouth of the cup 14 with the lip 24 of the lid 22 exerting a light pressure radially inwardly against the upper extremity of the wall 16. The annular guard 12 extends upwardly and outwardly from the wall 16 and above the level of the lid 22 to coaxially surround the rim 18 and the lid 22 in spaced separation therefrom, as depicted in FIG. 2.

FIG. 3 illustrates the guard 12 in isolation removed from the cup 14. The guard 12 is formed as a sleeve which may be removably disposed about the upper portion of the wall 16 of the cup 10, as depicted in FIGS. 1 and 2. The guard 12 is formed as an annular frusto-conical structure having an upper edge 26 forming a circular opening of diameter greater than that of the lid 22. As depicted in FIG. 2, when the guard 12 is positioned on the cup 14 the upper guard edge 26 coaxially surrounds the lid 22 in spaced separation therefrom. The lower edge 28 of the sleeve of the guard 12 forms a circular opening of diameter greater than the diameter of the circular cup base 20 and less than the diameter of the cup rim 18.

As is evident from FIG. 2, the draft or taper of the sleeve of the guard 12 is significantly greater than that of the wall 16 of the cup 14. This geometric relationship allows the guard 12 to be installed on the cup 14 from beneath the base 20 by moving the guard 12 upwardly in its upright orientation until the upper edge 26 of the guard 12 is at or above the level of the lid 22 and the lower edge 28 of the guard 12 is snugly secured in frictional engagement and in contact throughout its inner circumference against the wall 16 of the cup 14.

When the guard 12 is installed on the cup 14 in the manner depicted in FIG. 2, a plurality of beverage containers 10 may be packaged together in a conventional manner without danger of dislodgment of the lids 22 thereof. Since the cups 14 are of a frusto-conical configuration, with mouths of diameter larger than the diameter of the bases, it is inevitable that the upper edges or rims of the containers 10 will be jostled together. However, when the guards 12 are installed on the cups 14 in the manner depicted in FIG. 2, the lids 22 cannot be jarred loose from the rims 18 forming the mouths of the cups 14 because even heavy jostling exerts no forces against the edges of the lids 22. To the contrary, jostling of adjacent containers 10 will merely result in resilient deflection of the sleeves 12. Due to the spaced separation of the upper edges 26 of the sleeves 12 from the lids 22 and from the rims 18, force and pressure apply from adjacent containers will not cause the lids 22 to be dislodged so that liquid 30 within the containers 10 will spill. To the contrary, the improved beverage containers 10 of the invention allow liquid 30 to be carried within the cups 14 without appreciable danger of spillage.

It should be noted that if any liquid 30 should accidentally escape out of the mouth over the rim 18 of the cup 14, it will be confined to the gutter 32 defined between the lower edge 28 of the sleeve 12 and the upper region of the wall 16 of the cup 14. This will prevent any appreciable amount of liquid from escaping down the wall 16 to soak food packaged therewith or to soil the interior upholstery of a vehicle in which the beverage container 10 may be transported. The lower edge 28 of the sleeve 12 resides in contact with the wall 16 of the cup 14 throughout the circumference thereof, and forms a fairly liquid tight seal.

When the beverage 30 is packaged and served to the consumer, the guard 12 forms an annular collar that is secured to the cup 14 to surround the annular rim 18 forming the mouth thereof in spaced separation therefrom to thereby serve as a protective shield about the rim 18 of the cup mouth. The lid 22 extends transversely across the mouth 18. When the beverage 30 is to be imbibed from the cup 14, the annular guard 12 is pressed downwardly from the installed position, depicted in FIGS. 1 and 2 until the upper edge 26 of the shield 12 is significantly beneath the rim 18. The lid 22 is removed and the consumer is able to imbibe the beverage 30 with his or her lips in contact with the rim 18 of the mouth of the cup 14.

Preferably, both the cup 14 and the guard 12 are constructed of the same material, which may, for example, be styrofoam or plastic coated paper or cardboard. The lid 22 is typically constructed of thin, transparent or translucent plastic.

An alternative embodiment of the invention is depicted in FIGS. 4 through 7. In the disposable beverage container 10' depicted in those drawing figures, the concave cup 14' has an annular wall 16' tapered with a draft. The guard 12' and the cup 14' are formed as a unitary molded structure wherein the guard 12' flares upwardly and outwardly from the wall 16' of the cup 14' to a level above the lid 22. As in the embodiments of FIGS. 1-3, the upper edge 26' of the guard 12' is at or above the level of the lid 22. The guard 12' thereby prevents pressure from adjacent containers 10' from jarring the lid 22 loose from the mouth rim 18' of the cup 14'.

Because the guard 12' and the cup 14' are formed as a unitary structure, it is necessary to provide access to the rim 18' of the mouth so that a consumer may drink the beverage 30 contained within the cup 14'. To provide such access, the collar 12' includes a lip access panel or breakaway section 34 which is delineated by a boundary 36 formed as a weakened, crescent-shaped line in the structure of the collar 12'.

The breakaway section or lip access panel 34 may be removed from the remainder of the collar 12' by gripping the cup 14' in one hand and by grasping the breakaway section 34 between the thumb and forefinger of the opposite hand. The thumb and forefinger gripping the breakaway panel 34' are twisted to pull the lip access panel 34 outwardly and downwardly, relative to the remaining structure of the collar 12'. The breakaway section 34 thereby separates from the remainder of the collar 12' along the demarcation of the boundary 36 when force is applied thereto. FIG. 6 illustrates the cup of FIG. 4 once the breakaway section or lip access panel 34 has been removed therefrom. Linear weakness may be formed at the boundary 36 by reducing the thickness of material along the boundary 36, by perforations through the wall thickness of the shield 12' along the boundary 36, or be scoring the structure of the shield 12' along the boundary 36. Other conventional methods of forming weakened, easily frangible webs may also be employed.

In a variation of the embodiment of the invention depicted in FIGS. 4-7, the collar may be formed as a deformable structure which may initially be provided in a position folded down alongside the outer wall of the cup as indicated in dotted lines at 12" in FIG. 5. In such an arrangement the container 10' may be shipped and stored prior to use with the collar folded down as indicated at 12". Once the container 10' is filled with a beverage, however, the collar is folded up from the position indicated at 12" to the position indicated at 12' in FIG. 5. The collar will then perform the same function as previously described. When the user wishes to imbibe the beverage 30, the collar is merely again folded back down alongside the wall 16' of the container 10' to the position indicated at 12", so that the mouth 18' of the cup 14' is accessible to the lips of the user. The beverage 30 may thereupon be consumed. Such a collar construction on a unitary molded structure avoids the necessity for a breakaway panel.

With beverage containers constructed according to the invention the likelihood of dislodgement of drinking cup lids on disposable beverage containers which are being transported for consumption elsewhere is greatly reduced. This reduces the extent to which beverages are spilled, thus resulting in reduced incidences of soiling of food and automotive vehicle upholstery. The improved beverage container construction of the invention is quite economical, and lends itself well to the construction of commercially competitive disposable beverage containers.

Undoubtedly, numerous variations and modifications of the invention will become readily apparent to those familiar with disposable beverage containers. Accordingly, the scope of the invention should not be construed as limited to the specific embodiments described herein, but rather is defined in the claims appended hereto.

I claim:

1. In a disposable beverage container formed with a cup having an annular wall that forms an annular rim at its upper edge defining an open mouth and a lid releasably secured to externally encompass and grip said annular rim across said open mouth, the improvement comprising: an annular collar which in its position of ultimate deployment of use is secured to said annular wall of said cup and extends upwardly and outwardly from said annular wall of said cup from beneath said annular rim to form an upper edge which surrounds said annular rim in substantially longitudinal alignment therewith and transversely spaced separation therefrom so as to define an upwardly opening gutter between said annular wall and said collar to thereby serve as a protective shield about said rim.

2. A disposable beverage container according to claim 1 wherein said cup has an annular wall tapered with a draft and said collar is formed as an annular frusto-conical sleeve having upper and lower edges and is disposed about said wall of said cup so that said lower edge is in contact therewith and said upper edge is disposed outwardly from said rim of said cup in spaced separation therefrom.

3. A disposable beverage container according to claim 2 wherein said lower edge of said sleeve resides in contact with said wall of said cup throughout the circumference thereof.

4. A disposable beverage container according to claim 1 wherein said cup and said collar are formed as a unitary structure, and said collar includes a breakaway section delineated by a boundary formed as a weakened line in the structure of said collar, whereby said breakaway section separates from the remainder of said collar along said boundary when force is applied thereto.

5. An improved, disposable beverage container comprising a concave cup having an annular wall that forms an annular rim defining an open mouth at its upper edge, a lid which extends transversely across said mouth to externally encompass and grip said rim in releasable sealing engagement therewith, and an annular concentric guard which in ultimate position of deployment for use extends upwardly and outwardly from said wall of said cup from beneath said rim to define an upper edge which coaxially surrounds said mouth and resides in substantially longitudinal alignment therewith and in transversely spaced separation therefrom so as to define an upwardly opening gutter between said annular wall and said guard.

6. A beverage container according to claim 5 wherein said cup is of frusto-conical configuration having a draft and is of greatest diameter at its mouth and said guard is formed as a separate frusto-conical sleeve having an upper edge and a lower edge of smaller diameter than said upper edge, and said sleeve is removably positionable about said cup so that said upper edge of said sleeve is disposed coaxially around said mouth in spaced separation therefrom and said lower edge is disposed in contact with said wall of said cup.

7. A beverage container according to claim 5 wherein said guard and said cup are formed as a unitary structure, and said guard includes a removable lip access panel delineated by a linear weakness in said guard, whereby said lip access panel may be broken away from the remaining structure of said guard and said cup along said linear weakness.

8. A beverage container with a rim guard comprising a concave cup having a frusto-conical wall, a circular annular rim defining an open mouth at the upper extremity of said wall, and a circular base having a diameter smaller than that of said mouth at the lower extremity of said wall, a transverse circular lid releasably securable to said rim across said mouth to externally externally encompass and grip said mouth, and an annular guard which in its position of ultimate deployment for use extends upwardly and outwardly from said wall from beneath said annular rim to define an upper edge which is coaxial relative to said lid and which resides in substantially longitudinal alignment therewith and in transversely spaced separation therefrom to define an upwardly opening gutter between said annular wall and said guard.

9. A beverage container according to claim 8 wherein said guard is formed with a sleeve removably disposed on said wall of said cup and formed as an annular, frusto-conical structure having an upper edge forming a circular opening of diameter greater than that of said lid, whereby said upper guard edge coaxially surrounds said lid in spaced separation therefrom, and said lower edge of said sleeve forms a circular opening of diameter greater than the diameter of said circular cup base and less than the diameter of said cup mouth.

* * * * *